US008083102B2

(12) United States Patent
Murray

(10) Patent No.: US 8,083,102 B2
(45) Date of Patent: Dec. 27, 2011

(54) FLEXIBLE POUCH WITH A TUBE SPOUT FITMENT AND FLEXIBLE SLEEVE

(75) Inventor: R. Charles Murray, Sarasota, FL (US)

(73) Assignee: Pouch Pac Innovations, LLC, Sarasota, FL (US)

( * ) Notice: Subject to any disclaimer, the term of this patent is extended or adjusted under 35 U.S.C. 154(b) by 0 days.

(21) Appl. No.: 12/640,970

(22) Filed: Dec. 17, 2009

(65) Prior Publication Data

US 2010/0150478 A1 Jun. 17, 2010

Related U.S. Application Data

(63) Continuation-in-part of application No. 11/742,193, filed on Apr. 30, 2007, now abandoned.

(60) Provisional application No. 60/795,860, filed on Apr. 28, 2006.

(51) Int. Cl.

| | |
|---|---|
| ***B65D 35/00*** | (2006.01) |
| ***B65D 47/00*** | (2006.01) |
| ***B65D 33/16*** | (2006.01) |
| ***B65B 43/42*** | (2006.01) |

(52) U.S. Cl. ..... 222/107; 222/95; 222/547; 222/562; 222/541.9; 141/177; 141/182; 383/42; 383/904

(58) Field of Classification Search ..... 222/518, 222/519, 520, 521, 522, 523, 524, 525, 528, 222/529, 531, 532, 546, 464.3, 464.2, 499, 222/92, 93, 94, 95, 96, 97, 98, 99, 100, 101, 222/102, 103, 104, 105, 106, 107, 541.9, 222/547, 562, 1; 383/80, 904, 906, 42; 141/182, 141/177, 166, 67, 68, 312, 313, 328, 338, 337, 279

See application file for complete search history.

(56) References Cited

U.S. PATENT DOCUMENTS

| | | | |
|---|---|---|---|
| 733,449 | A | 7/1903 | Willsie |
| 2,008,216 | A | 6/1933 | Lombi |
| 2,106,028 | A | 3/1936 | Heimsch et al. |
| 2,189,174 | A | 2/1940 | Hohl |
| 2,759,643 | A | 2/1951 | Dahlin |
| 2,703,671 | A | 3/1955 | Kindseth |
| 3,010,619 | A | 10/1957 | Gronemeyer et al. |
| 3,286,005 | A | 11/1966 | Cook |

(Continued)

FOREIGN PATENT DOCUMENTS

| | | |
|---|---|---|
| EP | 0414992 | 3/1991 |

(Continued)

*Primary Examiner* — Kevin P Shaver
*Assistant Examiner* — Stephanie E Williams
(74) *Attorney, Agent, or Firm* — Gifford, Krass, Sprinkle, Anderson & Citkowski, P.C.

(57) ABSTRACT

A flexible pouch having a removable cap for use with the tube spout fitment and a method of filling the flexible pouch is provided. The removable cap is formed from a tube of pliable material, and has a first opening and a second opening. The first and second openings each have a peripheral edge. The peripheral edge of the first opening is configured to engage the outer surface of the tube spout fitment. The peripheral edge of the second opening is pressed onto itself and sealed so as to form a flattened edge. The method includes the steps mounting the removable cap onto the tube spout fitment. Filling the pouch, and sealing the second opening of the removable cap so as to form a flattened edge.

4 Claims, 5 Drawing Sheets

U.S. PATENT DOCUMENTS

| | | | | | |
|---|---|---|---|---|---|
| 3,304,977 | A | | 2/1967 | Hammons | |
| 3,356,244 | A | * | 12/1967 | Witchell | 215/49 |
| 3,690,524 | A | * | 9/1972 | Haberhauer | 222/573 |
| 3,855,907 | A | | 12/1974 | Johnson et al. | |
| 3,924,008 | A | | 12/1975 | Ford et al. | |
| 3,938,658 | A | | 2/1976 | Rohde | |
| 4,078,717 | A | | 3/1978 | Stearley | |
| 4,207,990 | A | * | 6/1980 | Weiler et al. | 220/267 |
| 4,326,568 | A | | 4/1982 | Burton et al. | |
| 4,361,235 | A | | 11/1982 | Gautier et al. | |
| 4,498,591 | A | | 2/1985 | Smith, II | |
| 4,519,499 | A | | 5/1985 | Stone et al. | |
| 4,669,124 | A | * | 5/1987 | Kimura | 383/80 |
| 4,690,304 | A | | 9/1987 | Morel et al. | |
| 4,717,046 | A | | 1/1988 | Brogli | |
| 4,718,778 | A | * | 1/1988 | Ichikawa | 383/100 |
| 4,808,010 | A | | 2/1989 | Vogan et al. | |
| 4,848,421 | A | | 7/1989 | Froese et al. | |
| 4,861,414 | A | | 8/1989 | Vogan et al. | |
| 4,867,131 | A | | 9/1989 | van der Merwe et al. | |
| 4,892,512 | A | | 1/1990 | Branson | |
| 4,905,452 | A | | 3/1990 | Vogan et al. | |
| 4,919,987 | A | | 4/1990 | Manner et al. | |
| 4,995,519 | A | * | 2/1991 | Rose et al. | 215/47 |
| 4,998,671 | A | | 3/1991 | Leifheit | |
| 4,999,978 | A | | 3/1991 | Kohlbach et al. | |
| 5,104,008 | A | | 4/1992 | Crisci | |
| 5,221,029 | A | * | 6/1993 | Stull | 222/541.9 |
| 5,222,535 | A | | 6/1993 | Roders | |
| 5,267,591 | A | | 12/1993 | Wakabayashi et al. | |
| 5,377,873 | A | | 1/1995 | Minnette | |
| 5,433,526 | A | | 7/1995 | Wild et al. | |
| 5,465,707 | A | | 11/1995 | Fulcher et al. | |
| 5,485,714 | A | | 1/1996 | Montalvo | |
| 5,492,219 | A | | 2/1996 | Stupar | |
| 5,836,445 | A | | 11/1998 | Provonchee | |
| 5,845,466 | A | | 12/1998 | Laudenberg et al. | |
| 5,855,544 | A | | 1/1999 | Buchanan | |
| 5,906,438 | A | | 5/1999 | Laudenberg et al. | |
| 5,911,340 | A | | 6/1999 | Uematsu et al. | |
| 5,954,432 | A | | 9/1999 | Laudenberg et al. | |
| 5,971,613 | A | | 10/1999 | Bell | |
| 6,000,848 | A | * | 12/1999 | Massioui | 383/80 |
| 6,039,218 | A | | 3/2000 | Beck | |
| 6,065,651 | A | | 5/2000 | Tedeschi, Jr. et al. | |
| 6,095,375 | A | | 8/2000 | Adams et al. | |
| 6,116,231 | A | | 9/2000 | Sabin et al. | |
| 6,199,601 | B1 | | 3/2001 | Laudenberg | |
| 6,206,230 | B1 | | 3/2001 | Wan et al. | |
| 6,217,497 | B1 | | 4/2001 | Laudenberg et al. | |
| 6,241,122 | B1 | | 6/2001 | Araki et al. | |
| 6,276,788 | B1 | | 8/2001 | Hilton | |
| 6,422,753 | B1 | | 7/2002 | Thomas | |
| 6,439,429 | B1 | | 8/2002 | Gross | |
| 6,513,516 | B2 | | 2/2003 | Sabin et al. | |
| D474,682 | S | | 5/2003 | Berman | |
| 6,571,994 | B1 | | 6/2003 | Adams et al. | |
| 6,640,801 | B2 | | 11/2003 | Sabin et al. | |
| 6,651,848 | B1 | | 11/2003 | Redmond | |
| 6,691,902 | B2 | | 2/2004 | Gomez | |
| 6,779,694 | B2 | | 8/2004 | Young | |
| 6,935,492 | B1 | | 8/2005 | Loeb | |
| 6,981,614 | B2 | | 1/2006 | Niggemyer | |
| 7,143,911 | B2 | | 12/2006 | Stoneberg et al. | |
| 7,661,560 | B2 | * | 2/2010 | Murray | 222/107 |
| 7,810,680 | B2 | * | 10/2010 | Stull et al. | 222/541.9 |
| 2004/0206777 | A1 | | 10/2004 | Mertens | |
| 2005/0040181 | A1 | | 2/2005 | Kurosawa et al. | |
| 2007/0144113 | A1 | | 6/2007 | Murray | |

FOREIGN PATENT DOCUMENTS

| | | |
|---|---|---|
| EP | 1577223 | 9/2005 |
| GB | 1193813 | 6/1970 |
| JP | 10175649 | 6/1998 |
| JP | 11049186 | 2/1999 |
| JP | 11091807 | 4/1999 |
| JP | 2000281089 | 10/2000 |
| JP | 2000335594 | 12/2000 |
| JP | 2001048200 | 2/2001 |
| JP | 2001122206 | 5/2001 |
| JP | 2001130616 | 5/2001 |
| JP | 2004284619 | 10/2004 |
| JP | 2006273353 | 10/2006 |
| KR | 20040005793 | 1/2004 |
| WO | WO-2004054888 | 7/2004 |
| WO | WO-2006087740 | 8/2006 |
| WO | WO-2007037472 | 4/2007 |

* cited by examiner

FLEXIBLE POUCH WITH A TUBE SPOUT FITMENT AND FLEXIBLE SLEEVE

CROSS REFERENCE TO RELATED APPLICATIONS

This application is a continuation-in-part of U.S. patent application Ser. No. 11/742,193 filed Apr. 30, 2007, which claims priority of U.S. Provisional Patent Application Ser. No. 60/795,860 filed Apr. 28, 2006, which is incorporated herein by reference.

BACKGROUND OF THE INVENTION

1. Field of the Invention

The present invention relates generally to a flexible pouch for packaging a product. More specifically, the present invention relates to a flexible pouch with a tube spout and removable outer cap. The removable outer cap is formed from a pliable sheet of material.

2. Description of the Prior Art

Various types of disposable, portable containers are known in the art for storing products, such as a liquid, granular material, powder or the like. Examples such of containers include a cup, a metal can, a plastic bottle, a glass bottle or a flexible pouch. Consumers prefer the convenience of flexible pouches over other types of containers due to their shape, size, shelf life and storage adaptability. Manufacturers recognize the packaging benefits of a flexible pouch, since the pouch is relatively inexpensive and can be formed and filled on the same manufacturing line.

Flexible pouches are made from a flexible or pliable material, preferably an extrusion or a laminate composed of sheets of plastic or aluminum or the like. An outer layer of the material may include preprinted information, such as a logo or the like, to provide the consumer with information regarding the contents of the pouch. The pouch may be formed and/or filled using conventionally known manufacturing techniques, such as a horizontal form-fill-seal machine with a single or multiple lanes, a flat bed pre-made pouch machine, a vertical form-fill machine, or the like.

The pouch includes a tube spout fitment having a spout for dispensing the product. The pouch also includes a cap for enclosing the pouch and protecting the spout from contamination. Current caps are rigid and made from a rigid plastic such as hardened polypropylene. As such, currently known caps may become inoperable due to deformation from a load. Additionally, manufacturing commercially ready pouches with currently known and used caps requires the step of adding the cap onto the spout after filling operations. This increases manufacturing costs and time. Thus, it remains desirable to have a removable cap that is less expensive to manufacture than what is currently known and used. Furthermore, it remains desirable to have a removable cap that does not deform so as to become inoperable for covering the tube spout when subjected to a load.

SUMMARY OF THE INVENTION AND ADVANTAGES

The present invention is a flexible pouch having an improved removable cap for use with the tube spout fitment and a method of filling the flexible pouch. The cap is formed from a tube of pliable material, and has a first opening and a second opening. The first and second openings each have a peripheral edge. The peripheral edge of one of the openings is configured to engage the outer surface of the tube spout fitment. The peripheral edge of the other of the openings is pressed onto itself and sealed so as to form a flattened edge. The removable cap may further include an upper removable portion, a lower retained portion, and a line of weakening connecting the upper removable portion to the lower retained portion.

The method includes the steps of forming a flexible pouch from a sheet of flexible material. The sheet of flexible material is folded and sealed so as to form a pouch body having an opening adaptable to receive a tube spout fitment. The tube spout fitment is inserted into the opening of the pouch body and the tube spout fitment is ultrasonically or heat sealed to the opening so as to seal the tube spout fitment to the pouch body. A removable cap that is open at both ends is mounted onto the tube spout fitment. The pouch with the removable cap is transferred to a fill/seal machine and filled through the tube spout fitment. The upper opening of the removable cap is then sealed so as to form a flattened edge.

One advantage of the present invention is that a flexible pouch with a tube spout fitment and removable cap is provided that is relatively inexpensive to manufacture as compared to current flexible pouches. Specifically, the flexible pouch and the method of making a flexible pouch of the present invention simplifies the fill/seal process with respect to current practice in that the pouch can be filled directly through the tube spout with the cap already inserted onto the tube spout fitment. Other features and advantages of the present invention will be readily appreciated, as the same becomes better understood after reading the subsequent description taken in conjunction with the accompanying drawings.

DETAILED DESCRIPTION OF THE INVENTION

Figure 1:
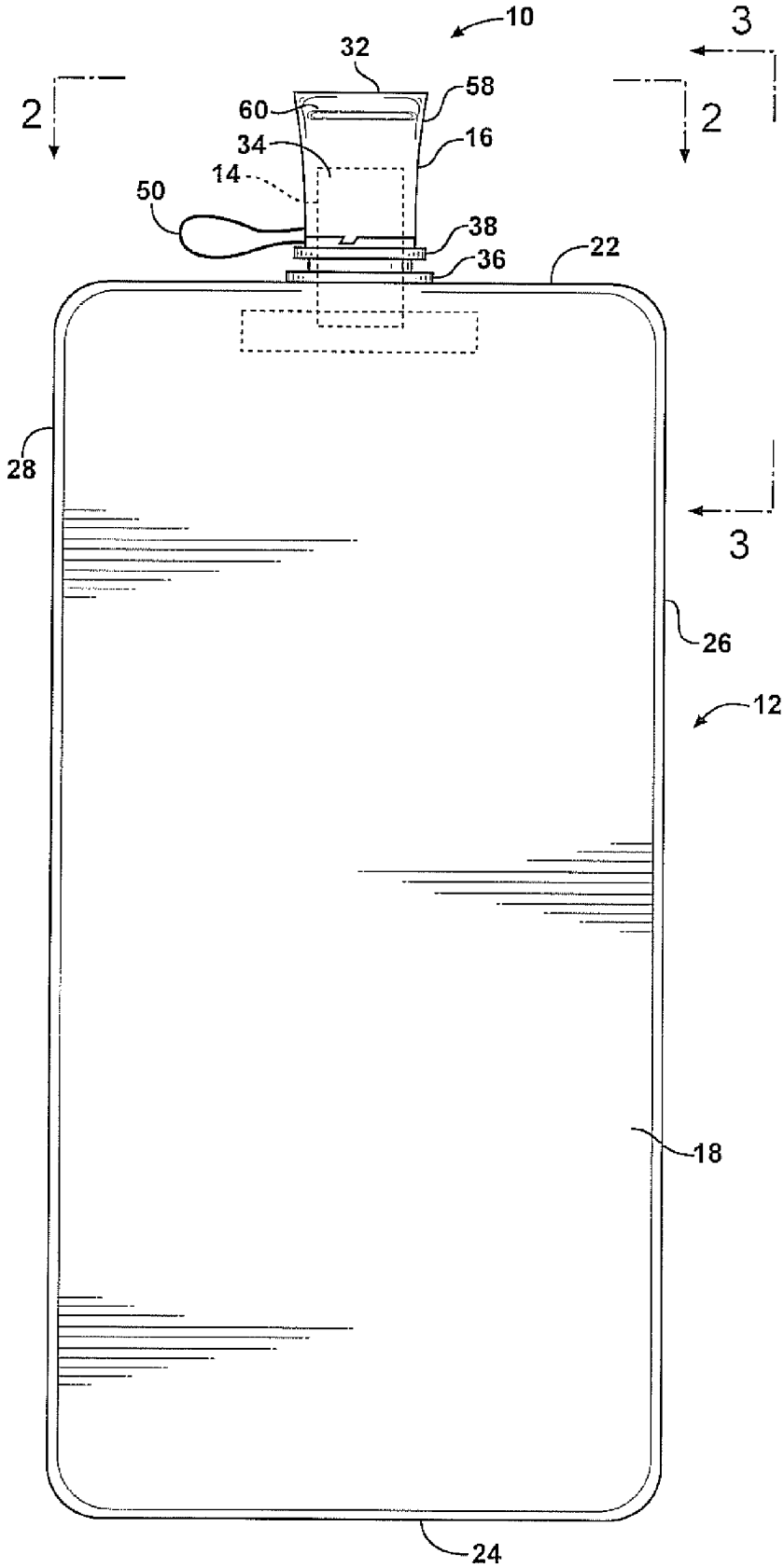
FIG. 1 is a perspective view of a flexible pouch with a removable cap according to the present invention.

Referring to FIGS. 1-6, a flexible pouch 10 is illustrated. The pouch 10 may be filled with a product and sealed. The pouch 10 includes a pouch body 12, a tube spout fitment 14, and a removable cap 16, also referenced herein as a "sleeve 16." The pouch body 12 may have a generally cylindrical shape, a box-like shape, an hourglass shape, a barrel shape or another shape. It is contemplated that the pouch body 12 may contain a single compartment or multiple compartments to segregate different products. In this example, the product is a beverage. The beverage may be carbonated, such as a sparkling wine.

The pouch body 12 further includes a front wall 18, and a back wall 20. The pouch body 12 may be formed from a sheet of flexible material such as aluminum laminate. Each wall is further defined by an upper edge 22, an opposed lower edge 24, and first and second side edges 26, 28 extending between the upper and lower edges 22, 24. The edges 22, 24, 26, 28, 30, 32 of the panel are sealed together with a portion of the edges 22, 24, 26, 28, 30, 32 spaced apart so as to form a pouch 10 opening.

The pouch 10 includes a tube spout fitment 14 sealed to the pouch 10 opening. The tube spout fitment 14 includes passageway 34 for providing access to the contents of the pouch 10. Various types of tube spout fitments 14 are known in the art for this purpose and are non-limiting. The position of the tube spout fitment 14 is determinable by many factors, such as type of tube spout fitment 14 being used. The tube spout fitment 14 may be positioned in an upper edge 22, a lower edge 24 or side edge, or front wall 18 or back wall 20, or on an insert or gusset. The fitment is sealed to the pouch 10 opening prior to filling the pouch 10.

The tube spout fitment 14 may include features for facilitating pouch 10 filling operations and pouch 10 using operations. For instance, the tube spout fitment 14 may include a first flange 36 that extends radially a predetermined distance from the outer surface of the tube spout fitment 14. A second flange 38 may be positioned a predetermined distance above the first flange 36. The first and second flanges 36, 38 providing a surface for manipulating the pouch 10 during filling operations. For instance, a robotic gripper may be configured to hold one of either the first or second flange 36, 38 during filling operations. Alternatively the pouch 10 may be suspended on a rail by the second flange 38. Additionally, the portion of the tube spout fitment 14 located between the first flange 36 and a second flange 38 advantageously provides a gripping surface for a robotic gripper during the manufacturing operation. The robotic gripper may be used to transport or support the pouch 10 during various manufacturing operations, such as opening, filling, or sealing or the like. The second flange 38 may also serve as a stop for the removable cap 16 in a manner to be described.

Figure 2:
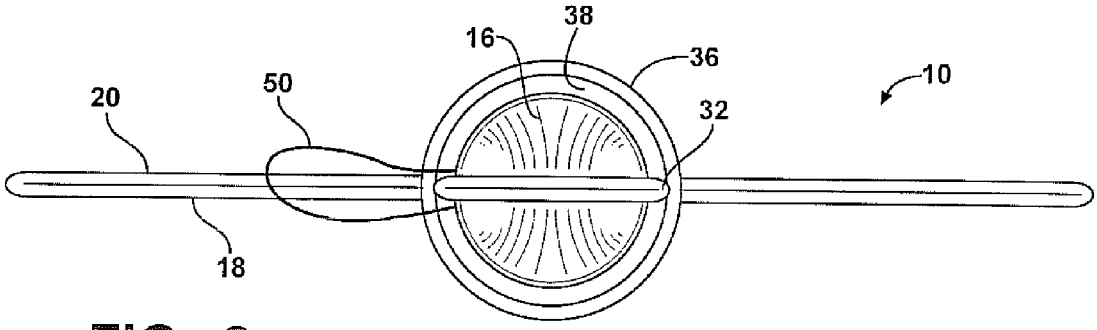
FIG. 2 is a top plan view of the flexible pouch of FIG. 1, showing the flattened edge of the removable cap.
Figure 3:
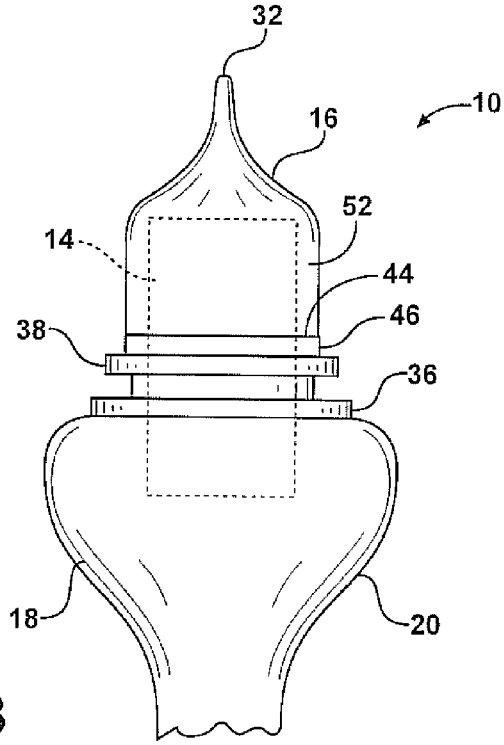
FIG. 3 is a side elevation view of the flexible pouch showing the tube spout fitment covered by the removable pouch.
Figure 5:
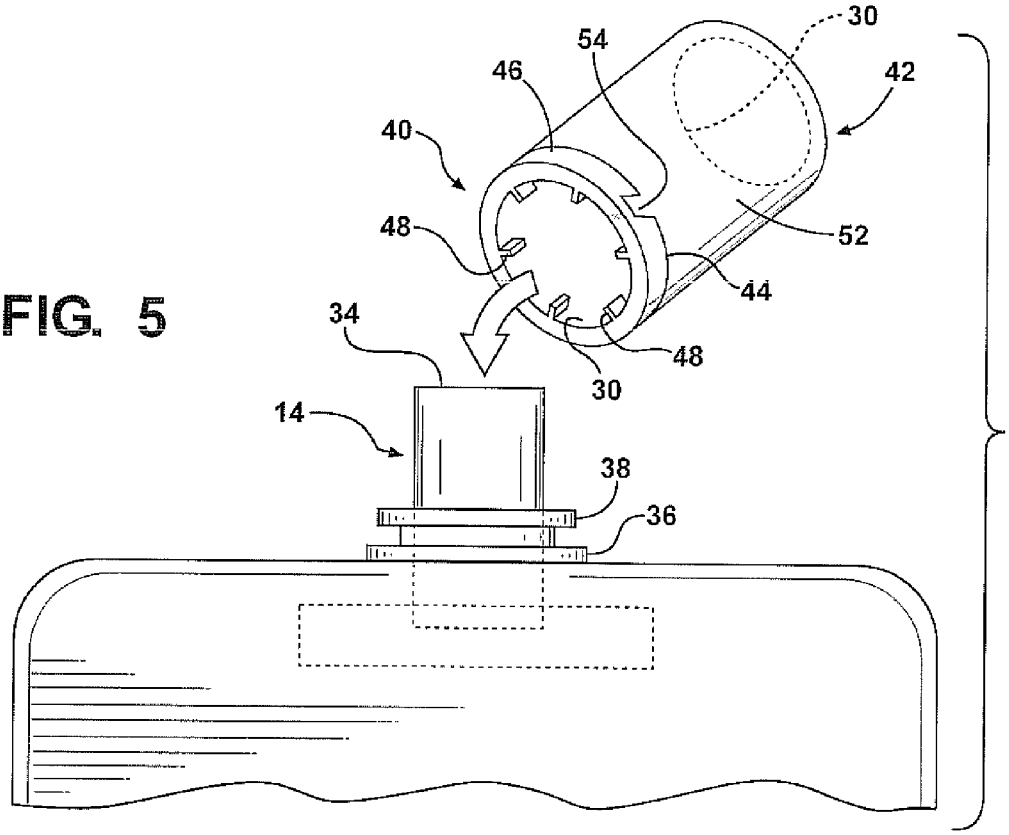
FIG. 5 is an exploded view of the flexible pouch showing the removable cap and the tube spout fitment.

Referring now to FIG. 5, the pouch 10 further includes a sleeve 16. The sleeve 16 is mounted onto the tube spout fitment 14 so as to contain the product within the pouch body 12. The sleeve 16 includes a first opening 40 opposite a second opening 42. The first and second openings 40, 42 each include a peripheral edge 30 defining respective first and second openings 40, 42. The first opening 40 of the sleeve 16 is secured to the tube spout fitment 14 prior to filling operations. With reference now to FIGS. 1, 2, and 3, the second opening 42 is later sealed so as to form a flattened edge 32 at the top end of the sleeve 16. Thus the sleeve 16 retains the contents of the pouch 10 within the pouch body 12. The sleeve 16 is generally cylindrical in shape, with a central passageway 34 configured to fittingly engage the outer surface of the tube spout fitment 14.

The sleeve 16 includes a line of weakening 44 that divides the sleeve 16 into a removable portion 54*a* and a retained portion 54*b*. The sleeve 16 is separated from the spout along this line of weakening 44. An example of a line of weakening 44 is a thin walled section of material that breaks upon the application of a force, so that the removable portion 54*a* of the sleeve 16 is removed from the internal tube, and retained portion 54*b* of the sleeve 16 remains secured to the internal tube. An inner surface of the retained portion 46 of the sleeve 16 may include a plurality of ribs 48 spaced a predetermined distance apart to assist in gripping the sleeve 16 onto the tube spout fitment 14.

The second opening 42 of the sleeve 16 is sealed, as shown in FIGS. 2 and 3 to prevent the product from leaking out of the pouch 10. The seal may be a heat seal or an ultrasonic seal. The removable portion 54*a* of the sleeve 16 may be peeled away from the tube spout fitment 14 along the line of weakening 44 so that the product is accessible via the tube spout fitment 14. The retained portion 54*b* of the tube remaining on the spout may serve as an indicator that the pouch 10 has been tampered with. The sleeve 16 may further include a tether 50. One end of the tether 50 is secured to the removable portion 52 of the external tube and the other end is secured to the tube spout fitment 14. The tether 50 is operable to retain the removable portion 52 to the pouch 10.

In another example, the inner surface of the retained portion 54*b* of the sleeve 16 includes a continuous horizontally oriented rib 54*c* to assist in retention on the internal spout. In still another example, a cord having one end attached to the sleeve 16 and a second end attached to the tube spout fitment 14 can be utilized to retain the removable portion 54*a* of the sleeve 16 on the fitment after removal from the tube spout fitment 14. In an alternative example, the sleeve 16 may have a tab 54 in communication with the line of weakening 44. The tab 54 operable to sever the thin walled section of material so as to separate the removable portion 52 from the retained portion 46. In operation, the tab 54 is pulled to sever the connecting walls 18, 20 to remove the sleeve 16 from the tube spout fitment 14.

The sleeve 16 and tube spout fitment 14 can be fabricated from a variety of materials. For example, the sleeve 16 is formed of a pliable material. For instance, the sleeve 16 may be formed from plastic, such as reground resins; Neoprene®; extruded polypropylene; rubber; synthetic rubber; and the like. The tube spout fitment 14 may be made of food grade polyethylene PE, or polypropylene PP or another type of heat sealable plastic, depending on the product.

Figure 4:
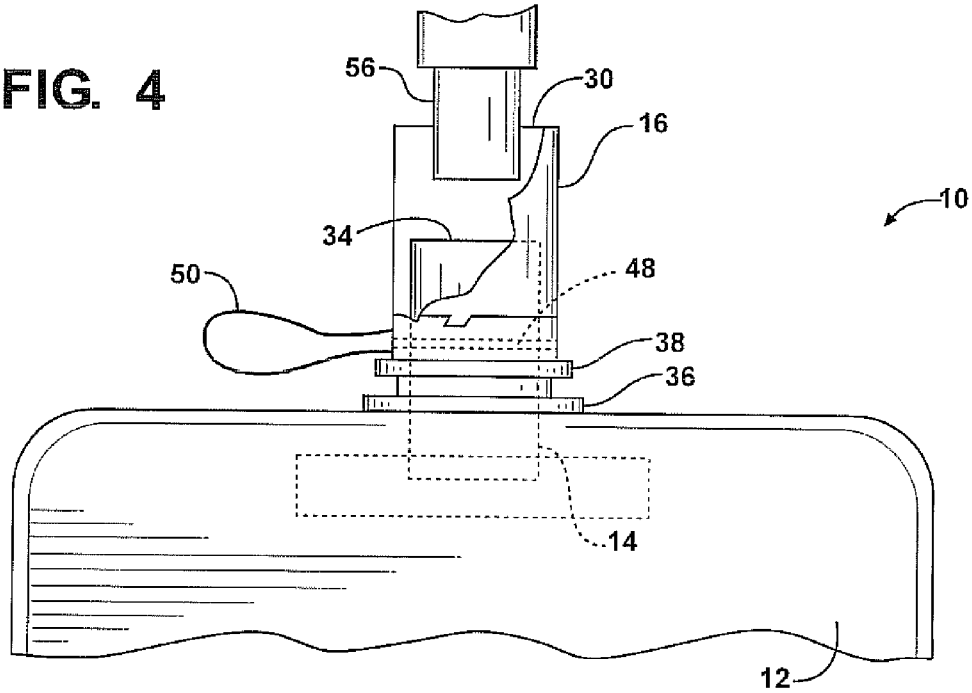
FIG. 4 is an elevational view of the flexible pouch showing the flexible pouch being filled prior to the open end of the removable pouch being sealed.
Figure 6:
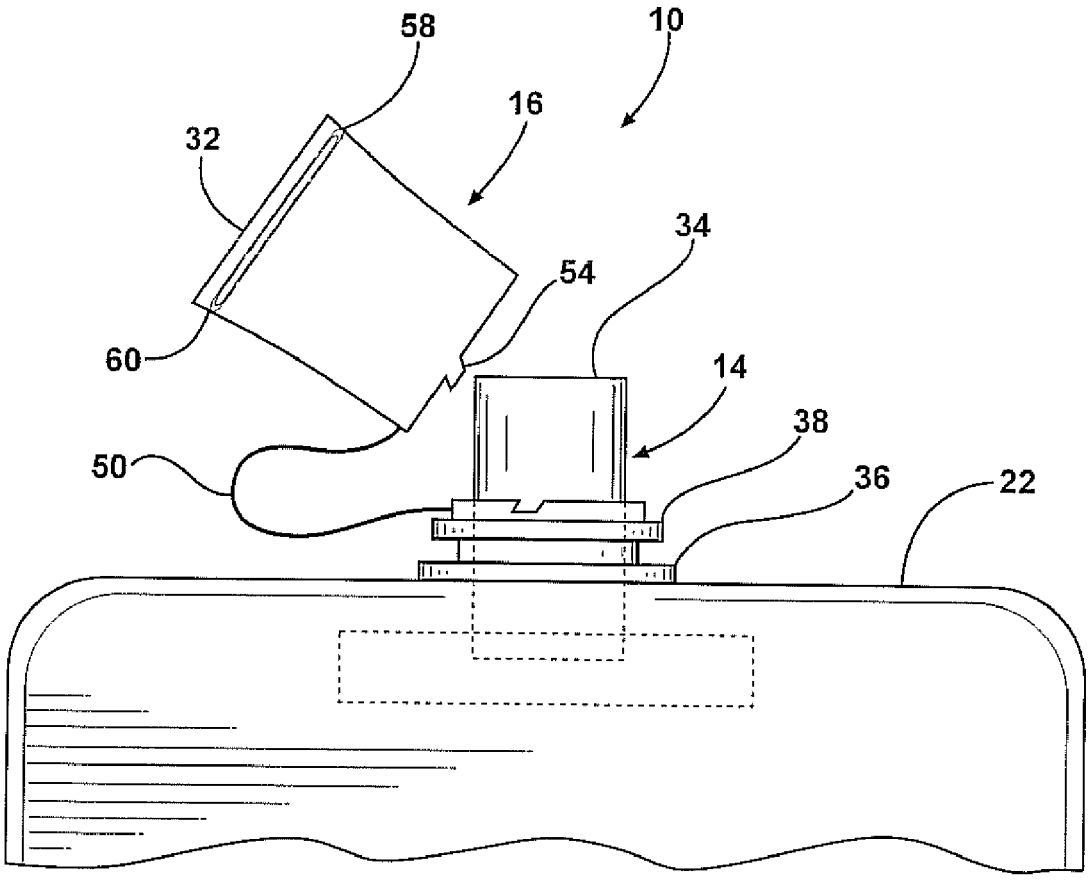
FIG. 6 is a view of the flexible pouch showing the removable portion of the removable cap displaced from the tube spout fitment.

In assembly, the sleeve 16 is pushed onto the tube spout fitment 14 as indicated in FIG. 5. The retained portion 46 is fixed to the sleeve 16 using fixing techniques currently known and used in the art such as ultrasonic welding, heat, or the like. The second flange 38 provides a stop for positioning the sleeve 16 relative to the tube spout fitment 14 as shown in FIG. 4. To remove the sleeve 16, the user applies a force to the removable portion 54*a* of the sleeve 16, to sever the thin walled section and peel away from the tube spout fitment 14, as shown in FIG. 6. The internal spout and contents of the pouch 10 are now accessible.

Figure 7:
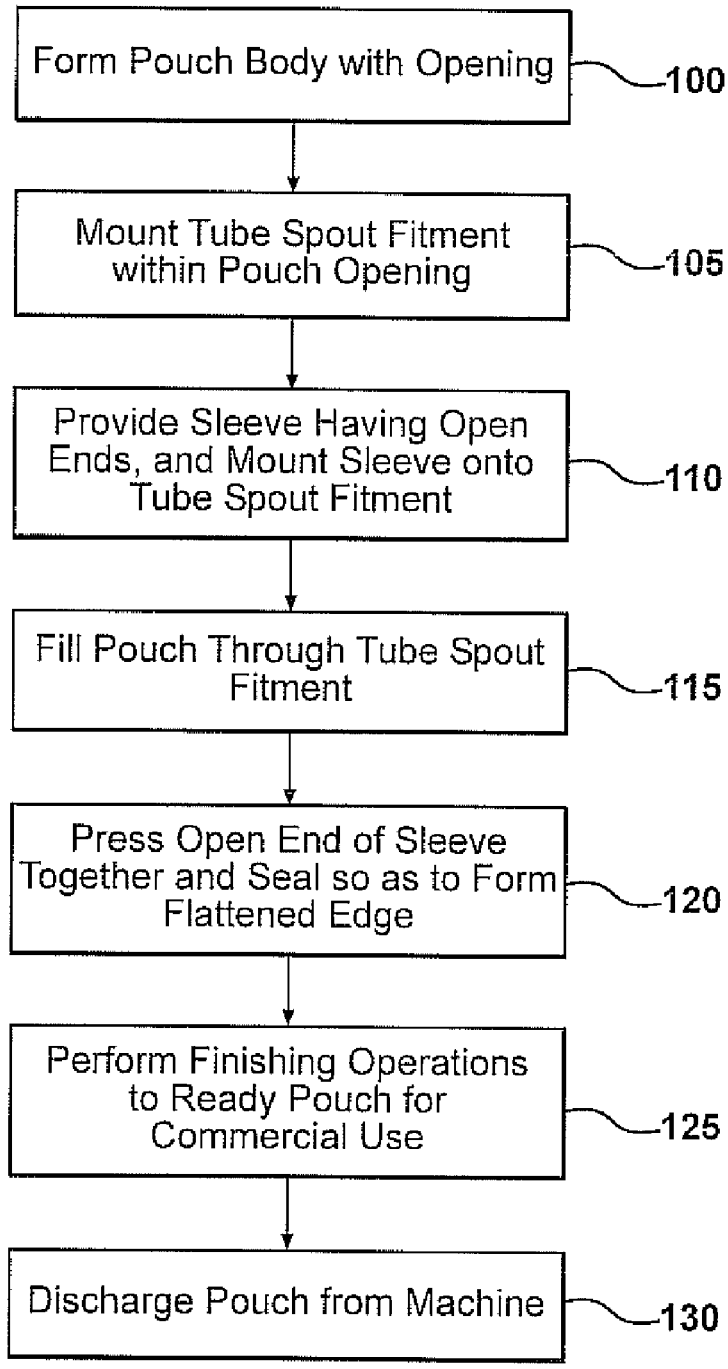
FIG. 7 is a diagram showing the steps of the method of filling the flexible pouch according to the present invention.

Referring to FIG. 7, a method for forming and filling the flexible pouch 10 is illustrated. The method begins in block 100 at a first station with the step of forming the body of the pouch 10. For example, a roll of laminate material is unrolled along a horizontally oriented plane. The initial width of the roll of material is determined by the desired finished size of the pouch 10 and the number of pouches 10 to be obtained from the width. The machine includes cutters, handlers and sealers for forming the roll of laminate material into pouches 10.

The sheet of laminate material may be preferably preprinted with information or locating indicia (not shown), such as a registration mark. The registration marks are located on the material to denote an edge of the panel. The registration marks are read by an optical reading device, such as a scanner or registration eye, to index the material in a predetermined position at the cutting station. The preprinted information may include labeling information that describes the product contained within the pouch 10. During pouch 10 forming operations features such as a gusset may be formed into the pouch body 12.

The methodology advances to block 105 where the tube spout fitment 14 is inserted into an opening of the pouch body 12. The tube spout fitment 14 is then sealed to the opening using techniques currently known and used in the art, such as an ultrasonic seal, or a heat weld, or by a combination of ultrasonic seal and heat weld, as previously described. Accordingly, the base portion of the fitment is sealed to the opening of the pouch body 12 and the seal may be cooled. For instance, a heat seal melts a layer of the pouch 10 material, and the material flows around the base of the tube spout fitment 14, and the melted layer is then cooled so as to fix the tube spout fitment 14 to the opening of the pouch body 12.

The methodology advances to block 110 where a sleeve 16 having open ends is provided. The sleeve 16 is mounted onto the tube spout fitment 14. The method advances to block and the formed pouch 10 is transferred to the filling station. The formed pouches 10 may be placed on a holder for moving the pouch 10 between stations. Alternatively, the second flange 38 of the formed pouches 10 may be carried by a rail. The formed pouches 10 are advanced so as to register the formed pouches 10 to receive products from a filling machine.

The methodology advances to block 115 wherein filling operations are conducted. The filling operations are conducted by the filling machine. The filling machine includes a fill tube 56 as shown in FIG. 4. The tube spout fitments 14 of the formed pouches 10 are registered to the fill tube 56 and the products are dispensed from the fill tube 56 into the pouch body 12 through the fill tube 56. The fill tube 56 may be lowered into the opening of the tube spout fitment 14 or may be displaced directly above the opening.

The methodology then proceeds to block 120, where the fill tube 56 is displaced free and clear of the sleeve 16. A sealing machine engages the open end of the sleeve 16 and seals the open end together so as to form a flattened edge 32. Specifically, the open end of the sleeve 16 is pressed against itself and sealed. The flattened edge 32 may be formed by an ultrasonic seal or an ultra pulse seal. A second seal 58 may be applied a predetermined distance apart from the flattened edge 32 so as to define a chamber 60, as indicated in FIG. 1. The chamber 60 may be desirable when a carbonated product is introduced into the pouch body 12. The second seal 58 may be a heat weld or a cosmetic seal or an ultrasonic seal or the like. The location of the second seal 58 is selected so that some of the product is trapped in the chamber 60 between the flattened edge 32 and the second seal 58. This is advantageous since it eliminates the potential for gas in the head space, i.e. the region between the product and the heat seal. Another advantage of the location of the second seal 58 is that the overall length of the pouch 10 may be reduced, resulting in less pouch 10 material.

The methodology advances to block 125 and the pouch 10 is finished in a finishing operation. For example, the edges 22, 24, 26, 28, 30 of the pouch 10 are trimmed to achieve a predetermined shape. In addition, the pouch 10 may be cooled at a cooling station, where the pouch 10 is cooled using a conventionally known cooling technique.

The methodology advances to block 130. In block the filled pouch 10 is discharged from the machine. A plurality of pouches 10 may be placed in a package for sales or shipping purposes. A plurality of pouches 10 may be placed in a package for sales or shipping purposes. The pouch 10 may be discharged back into a carrier rack for storage or into a case packed for shipping.

The present invention has been described in an illustrative manner. It is to be understood that the terminology which has been used is intended to be in the nature of words of description rather than of limitation. Many modifications and variations of the present invention are possible in light of the above teachings. Therefore, the present invention may be practiced other than as specifically described.

What is claimed is:

1. A method for filling a flexible pouch comprising:

providing a flexible pouch having a pouch body and a tube spout fitment, wherein the tube spout fitment includes a passageway to the pouch body;

providing a sleeve having a tubular body and a first opening opposite a second opening, the sleeve made of pliable material, the tubular body having a diameter, mounting the first opening of the sleeve over the tube spout fitment, the second opening having a peripheral edge;

filling the flexible pouch through the tube spout fitment; and flattening the peripheral edge of the sleeve and sealing the peripheral edge of the sleeve onto itself so as to form a flattened edge extending along the diameter of the tubular body, the tubular body tapering from the first opening to the flattened edge.

2. The method as set forth in claim 1, further including the step of forming a line of weakening on the sleeve, the line of weakening separating the sleeve into a removable portion and a retained portion, wherein the retained portion is fixedly mounted onto the tube spout fitment.

3. The method as set forth in claim 1, further including the step of providing a second seal on the sleeve, the second seal disposed between the flattened edge and the line of weakening so as to define a chamber between the second seal and the flattened edge, the chamber configured to trap product.

4. The method as set forth in claim 1, further including the step of providing a first flange and a second flange on the outer surface of the tube spout fitment, the first flange spaced apart the second flange, the second flange operable to serve as a stop for the sleeve mounting operations, and the second flange operable to provide a surface for handling the pouching during pouch filling operations.

* * * * *

UNITED STATES PATENT AND TRADEMARK OFFICE

CERTIFICATE OF CORRECTION

PATENT NO. : 8,083,102 B2
APPLICATION NO. : 12/640970
DATED : December 27, 2011
INVENTOR(S) : R. Charles Murray It is certified that error appears in the above-identified patent and that said Letters Patent is hereby corrected as shown below:

In the Specification:

At column 5, line number 12 After block Insert -- 115 --

At column 6, line number 3 After block Insert -- 130 --

At column 6, line number 6 After purposes Delete "A plurality of pouches 10 may be placed in a package for sales or shipping purposes"

Signed and Sealed this
Nineteenth Day of February, 2013

Teresa Stanek Rea

Teresa Stanek Rea
*Acting Director of the United States Patent and Trademark Office*